United States Patent [19]

Tittizer et al.

[11] Patent Number: 4,799,462

[45] Date of Patent: Jan. 24, 1989

[54] HYDRAULIC VALVE DRIVE FOR INTERNAL COMBUSTION ENGINES

[75] Inventors: Gabriel Tittizer, Rösrath; Ewald Junghans, Bergisch-Gladbach, both of Fed. Rep. of Germany

[73] Assignee: Interatom GmbH, Bergisch-Gladbach, Fed. Rep. of Germany

[21] Appl. No.: 52,247

[22] Filed: May 18, 1987

Related U.S. Application Data

[62] Division of Ser. No. 827,290, Feb. 6, 1986, abandoned.

[30] Foreign Application Priority Data

Feb. 11, 1985 [DE] Fed. Rep. of Germany ..... 3504639

[51] Int. Cl.[4] ..... F01L 9/02

[52] U.S. Cl. ..... 123/90.12

[58] Field of Search ..... 123/90.12, 90.13

[56] References Cited

U.S. PATENT DOCUMENTS

| | | | |
|---|---|---|---|
| 1,062,843 | 5/1913 | Murauer | 123/90.12 |
| 1,757,425 | 5/1930 | Hallett | 123/90.12 |
| 1,810,465 | 6/1931 | DaCosta | 123/90.12 |
| 2,306,131 | 12/1942 | Lossau | 123/90.12 |
| 2,635,544 | 4/1953 | Lossau | 123/90.13 |
| 2,962,013 | 11/1960 | Reggio | 123/90.12 |
| 4,258,672 | 3/1981 | Hietikko | 123/90.12 |

*Primary Examiner*—Andrew W. Dolinar

*Attorney, Agent, or Firm*—Herbert L. Lerner; Laurence A. Greenberg

[57] ABSTRACT

Valve drive for a combustion engine with an hydraulic transmission system between a control member and a valve includes a device for stepping up the hydraulic transmission.

2 Claims, 1 Drawing Sheet

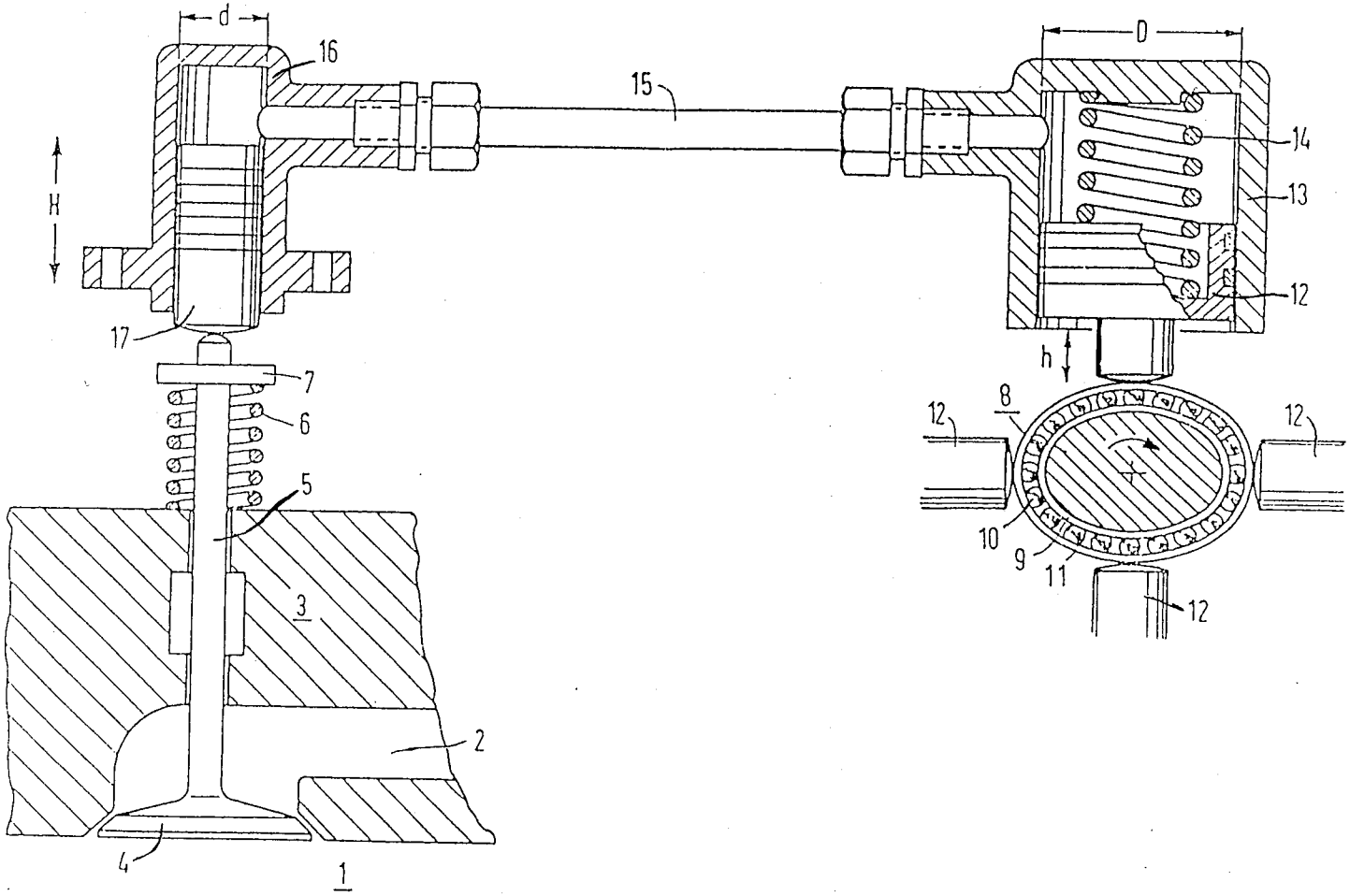
14
13
12
12
12
12
D
h
8
10
9
11
15
16
d
17
H
7
6
5
3
2
1
4

HYDRAULIC VALVE DRIVE FOR INTERNAL COMBUSTION ENGINES

This is a divisional of application Ser. No. 827,290, filed Feb. 6, 1986, now abandoned.

The invention relates to a valve drive for combustion engines, for example, four-cycle Otto and diesel motors, respectively, with an hydraulic transmission and, more particularly, to such an hydraulic transmission which connects a control member with the valve.

Such machines have at least two valves per cylinder which, in accordance with the prior state of the art, are forced by spring action into the closed position thereof and are thereby brought into the open position thereof by the application of a force to the valve shaft which is opposite to and exceeds the spring force; this is accomplished by mounting cams on an auxiliary shaft driven at half the rotary speed of the crankshaft, the cams applying the required force via rocking levers to the valve tappet. The cams and rocking levers are subjected to considerable wear by sliding against one another, and the length of the valve stroke or lift which is attainable is limited by the fact that the slide slope of the cams cannot be chosen to be arbitrarily large if the forces which are to be applied through the cooperation of the cams and the rocking levers are not supposed to exceed the permissible amount. Results of recent investigations support the assumption that more complete combustion in the cylinder and, accordingly, a more advantageous fuel utility and reduction in harmful material given off in the waste gas can be attainable by increasing the valve lift or stroke and/or by opening and closing the valve more rapidly, so that the rigid coupling of the setting or position of the valve to that of the piston is relaxed for all operating conditions. Such a coupling which is variable in accordance with the operating condition occurs, in fact, when ignition takes place in Otto engines. Hydraulic valve drives are known, for example, from German Pat. No. 467 440. Greater freedom of movement is achieved therewith in the coupling between the crankshaft and the closing member of the shaft. To compensate for loss of hydraulic liquid and prevent the occurrence of air bubbles in the system, the German patent suggests that the stroke volume or piston displacement of the primary, active hydraulic cylinder be designed somewhat larger than that of the secondary, passive cylinder and the thus advanced excess be permitted to flow or drain off.

Electromagnetic valve drives are also already known, for example, from German Published Nonprosecuted Applications Nos. 33 11 250 and 30 24 109. Attempts are made therein to move a closing member of the valve, which is constructed as an armature of an electromagnet, over the selected displacement path (which may be a few millimeters, for example, for a motor vehicle engine of 100 KW) by excitation of the electromagnetic. This requires relatively large electromagnets which are not only costly, but also are often very difficult to accommodate in the immediate vicinity of the motor block.

It is accordingly an object of the invention to provide a valve drive with an hydraulic transmission which, while basically maintaining the existing construction of the aforementioned engines, affords a greater valve stroke or lift than heretofore provided, and simultaneously eliminates wear-prone components and thereby attains more desirable control characteristics or behavior for the valve.

With the foregoing and other objects in view, there is provided, in accordance with the invention, a valve drive for a combustion engine with an hydraulic transmission system between a control member and a valve, comprising means for stepping up the hydraulic transmission.

In accordance with another feature of the invention, the valve has a first cylinder wherein a first piston displaceable by the control member slides and a second cylinder tightly connected by at least one line to the first cylinder and having a second piston slidable therein for moving the valve, the diameter of the first cylinder being larger than the diameter of the second cylinder, the first and the second cylinder and the at least one line forming a closed system. The first piston thus follows the movement executed by the second piston with a stroke distance or lift which is increased in accordance with the difference in the respective cross-sectional areas of the cylinders, when the system is closed.

In accordance with a further feature of the invention, the combustion engine has a crankshaft, and an auxiliary shaft is driven by the crankshaft and has at least a portion of the length thereof formed with a noncircular cross section, a rolling bearing is mounted on the auxiliary shaft and has an outer race fixed in space and forcibly deformed by rotation of the auxiliary shaft, the outer race being stressed only within elastic limits, the first piston being pressed against the outer race. The movement of the pistons in their cylinders is effected largely free of wear because of the absence of lateral or shearing forces from stressing the sliding surfaces. If a rolling bearing having races which are elastically deformable in the macroscopic range by reducing the the thickness of the material thereof and by selecting the suitable material, in accordance with the invention, is slid onto a noncircular shaft, the inner race then conforms to the noncircular contour, and the outer race does so as well due to the virtually nondeformable rolling bodies such as the balls or rollers. If the shaft rotates with respect to the assumably fixed outer bearing race, a radially reciprocating movement is imparted to the latter at every point of the periphery thereof. This movement is then hydraulically transmitted, no relative movement occurring between the outer bearing race and the primary piston and consequently no wear resulting.

In accordance with a concomitant feature of the invention, the valve shaft with the valve disc formed thereon is integrated with the second piston, the possibility of having play in the transmission being thereby further reduced.

Other features which are considered as characteristic for the invention are set forth in the appended claims.

Although the invention is illustrated and described herein as embodied in a valve drive with an hydraulic transmission, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing.

The figure shows a diagrammatic sectional view of the valve drive with an hydraulic transmission, according to the invention, having a purely mechanical-hydraulic construction.

Referring now to the single figure of the drawing, there is shown part of a combustion chamber 1 of a cylinder of a combustion engine, to which a fuel-air mixture is fed via a suction or intake channel 2. A non-illustrated outlet channel for the combustion products can generally be constructed in a similar manner. The suction or intake channel 2 is closed off from the combustion chamber 1 by a valve disc 4 forming a unitary structure with a tappet 5. By means of an helical spring 6, which is braced against an abutment 7, the valve disc 4 is biased in closing direction of the valve. An auxiliary shaft 8 (shown enlarged or exaggerated herein in the interest of clarity) is driven by a non-illustrated crankshaft of the machine with a reduction ratio of 2:1. The auxiliary shaft 8 has a noncircular cross section and carriers a roller bearing formed, in a conventional manner, of an inner bearing race 9, rolling bodies 10 (balls or rollers) and an outer bearing race 11. The bearing races 9 and 11, in accordance with the dimensions and material thereof, are able to follow to a given extent deformations which are imposed thereon without stressing these components beyond their elastic limit. This is the case because the outer bearing race 11 is fixed in space so that it cannot follow rotary movement in circumferential direction of the auxiliary shaft 8 and the inner bearing race 9 secured thereon, and instead performs an oscillating radial movement depending upon the respective angular position of the auxiliary shaft 8. The shape thereof is not necessarily a double oval, as represented herein, but rather, is selected by the person of skill in the art depending upon the valve control times which are sought after, such a shape being also one which is not dissimilar to cams which are conventionally used for valve controls. The movement of the outer bearing race 11 is imparted to a first piston 12 sliding in a first hydraulic cylinder 13 and continuously biased by another helical spring 14 against the outer bearing race 11. The first hydraulic cylinder 13 is connected via a line 15 formed virtually of any length or shape to a second hydraulic cylinder 16 wherein a second piston slides, which acts, in turn, upon the valve shaft 5. Because the volumes swept by both pistons 12 and 17 must be equal and the diameter D of the first cylinder 13 is greater than the diameter d of the second cylinder 16, the relatively small reciprocating movement h of the first piston 12 is transposed into a correspondingly larger movement H of the second piston 17. The length of the corresponding stroke of the valve 4 can thus be increased beyond that attainable with the aid of conventional cam shafts.

As indicated, the outer bearing race 11 simultaneously actuates several first pistons 12 distributed over the periphery thereof which control, via the hereinaforedescribed similar hydraulic transmissions, a like number of nonillustrated valves 4, the four inlet valves of a four cylinder engine in the case of the embodiment described herein.

We claim:

1. Valve drive for a combustion engine with a hydraulic tranmission system between a control member and a valve, comprising means for stepping up the hydraulic transmission, the valve having a first cylinder wherein a first piston displaceable by the control member slides and a second cylinder tightly connected by at least one line to said first cylinder and having a second piston slideable therein for moving the valve, the diameter of said first cylinder being larger than the diameter of said second cylinder, said first and second cylinder and said at least one line forming a closed system, the combustion engine having a crankshaft, and including an auxiliary shaft driven by the crankshaft and having at least a portion of the length thereof formed with a noncircular cross section, a rolling bearing mounted on said auxiliary shaft and having an outer race fixed in space and being forcibly deformed by rotation of said auxiliary shaft and stressing of said outer race only within elastic limits, and means for pressing said first piston against said outer race for eliminating relative motion therebetween during operation of the valve drive.

2. Valve drive according to claim 1, wherein said rolling bearing has a permanently deformed inner race and rolling bodies disposed between said races.

* * * * *